US009376170B1

(12) United States Patent
Delgado

(10) Patent No.: US 9,376,170 B1
(45) Date of Patent: Jun. 28, 2016

(54) REMOVABLE HOUSING FOR BOATS

(71) Applicant: Sun Blue Enterprises, Inc., Miami, FL (US)

(72) Inventor: Jose Delgado, Miami, FL (US)

(73) Assignee: Jose Delgado, Miami, FL (US)

( * ) Notice: Subject to any disclaimer, the term of this patent is extended or adjusted under 35 U.S.C. 154(b) by 0 days.

(21) Appl. No.: 14/686,421

(22) Filed: Apr. 14, 2015

(51) Int. Cl.
*B63B 17/02* (2006.01)

(52) U.S. Cl.
CPC ..... *B63B 17/02* (2013.01)

(58) Field of Classification Search
CPC ..... B63B 17/00; B63B 17/02; B63B 17/04
USPC ..... 114/361, 364
See application file for complete search history.

(56) References Cited

U.S. PATENT DOCUMENTS 3,106,931 A * 10/1963 Cooper ..... B63B 17/04 114/361
6,260,505 B1 * 7/2001 Polidan ..... B63B 17/02 114/361
6,691,637 B1 * 2/2004 Smith ..... B63B 17/02 114/361
7,231,883 B1 * 6/2007 Cooper ..... B63B 17/02 114/361
7,472,666 B1 * 1/2009 Richard ..... B63B 17/02 114/361

* cited by examiner

*Primary Examiner* — Lars A Olson
(74) *Attorney, Agent, or Firm* — Christian Sanchelima; Jesus Sanchelima

(57) ABSTRACT

A housing for a boat that does not alter the structure of the vessel by requiring the drilling of holes into the hull. The present invention can be implemented into T-Top or Hard Top style open fisherman type boats. The cover assembly includes a plurality of window openings having a screen to allow light and wind to enter while keeping unwanted insects and debris out. The frame attached to the cover unit is mounted to a boat with a T-Top using clamps while suction anchoring members are used to connect the frame on a Hard Top style boat. In both embodiments, suction anchoring members are used to secure the rod members making up the frame assembly to the boat's hull.

16 Claims, 15 Drawing Sheets

REMOVABLE HOUSING FOR BOATS

BACKGROUND OF THE INVENTION

1. Field of the Invention

The present invention relates to a housing for boats and, more particularly, to a removable housing for boats that is not intrusive to the structure of the boat.

2. Description of the Related Art

Several designs for boat covers have been designed in the past. None of them, however, include a housing made of rods that are secured to a boat without affecting the structure of the boat.

Applicant believes that a related reference corresponds to U.S. Pat. No. 6,725,871 issued to Nelson A. Taylor Co., Inc. for a portable cover unit. The Taylor reference includes frame connectors that are configured as sleeves that receive primary frame members to create the frame of the cover unit. In addition, a fabric is attached to the sleeves that extend along the length of the cover unit to provide shading and cover. However, it differs from the present invention because it does not teach of a way to secure the frame to a "T-Top" or "Hard Top" style boat. The Taylor reference also fails to disclose of a mounting means that securely attaches the frame to the boat without affecting the structure of the boat. Also, the Taylor reference does not teach of openings for windows having screens that allow light and wind to pass through while keeping unwanted debris and insects outs.

Other documents describing the closest subject matter provide for a number of more or less complicated features that fail to solve the problem in an efficient and economical way. None of these patents suggest the novel features of the present invention.

SUMMARY OF THE INVENTION

It is one of the main objects of the present invention to provide a housing to provide cover and shade for users on a boat while the boat is stationary.

It is another object of this invention to provide such a housing including a frame that can be secured to T-Top or Hard Top style boats as well as to the outer or inner perimeter of the boat without having to modify the boat's structure or open holes into the boat.

It is still another object of the present invention to provide a housing having windows that include a screen to allow light and wind to pass while keeping out unwanted debris and insects.

It is yet another object of this invention to provide such a housing that is inexpensive to implement and maintain while retaining its effectiveness.

It is another object of this invention to provide a housing that can be disassembled and readily stored in a case or bag for easy transportation.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
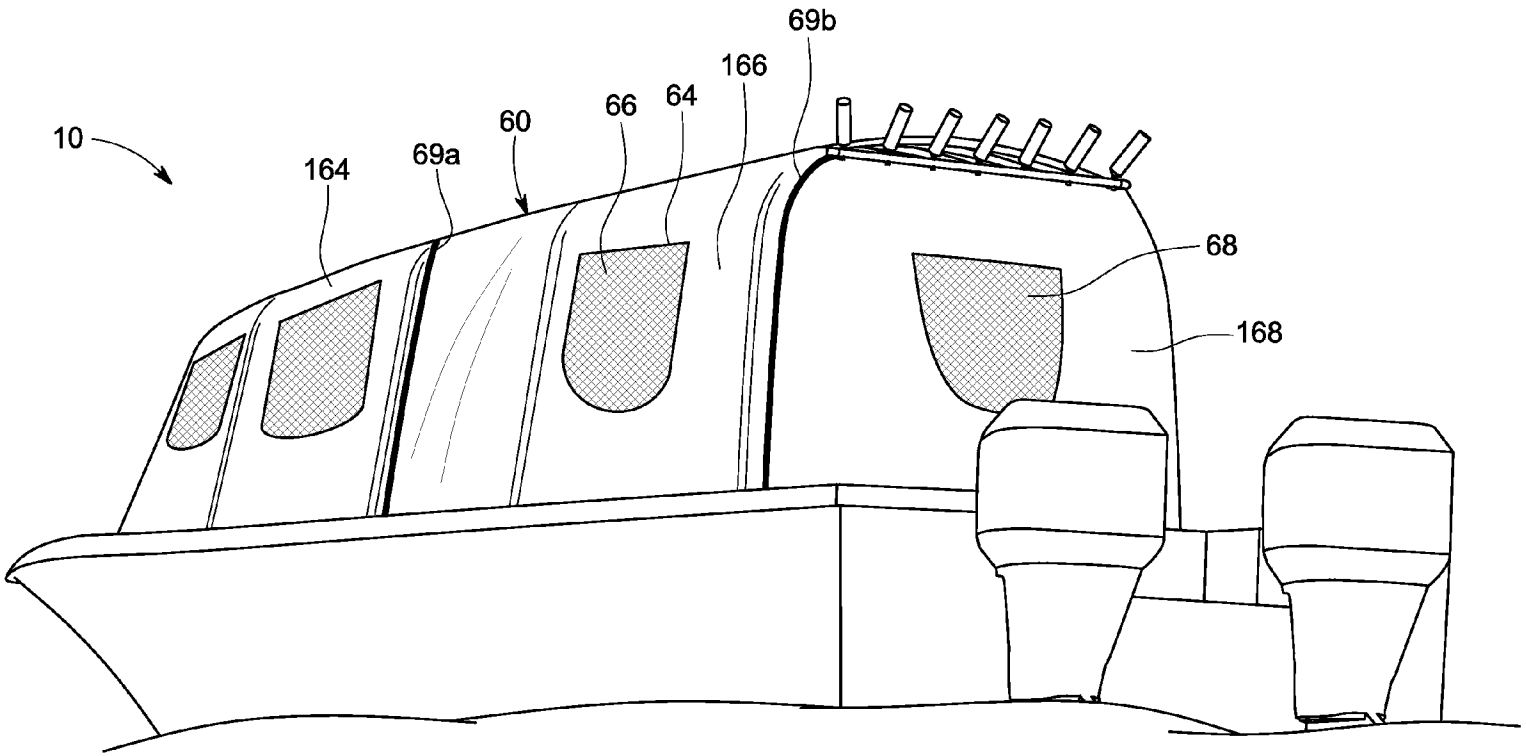
FIG. 1 represents an isometric view of the present invention mounted to a boat. Front cover units 164, side cover unit 166; and rear cover unit 168 can be seen in the closed position.
Figure 1A:
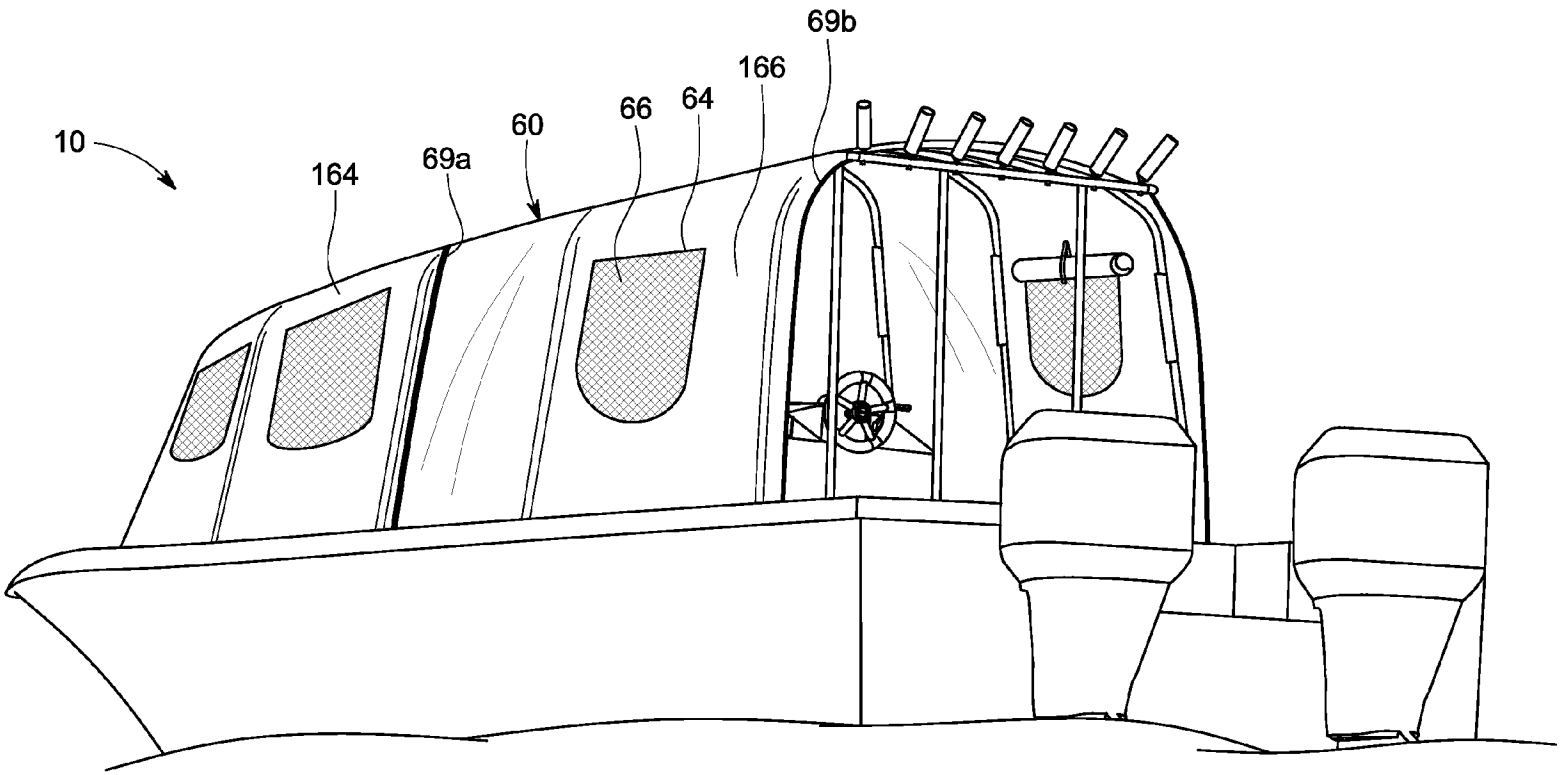
FIG. 1A shows an isometric view of the present invention mounted to a boat. Rear cover unit 168 has been removed and is therefore not shown.
Figure 2:
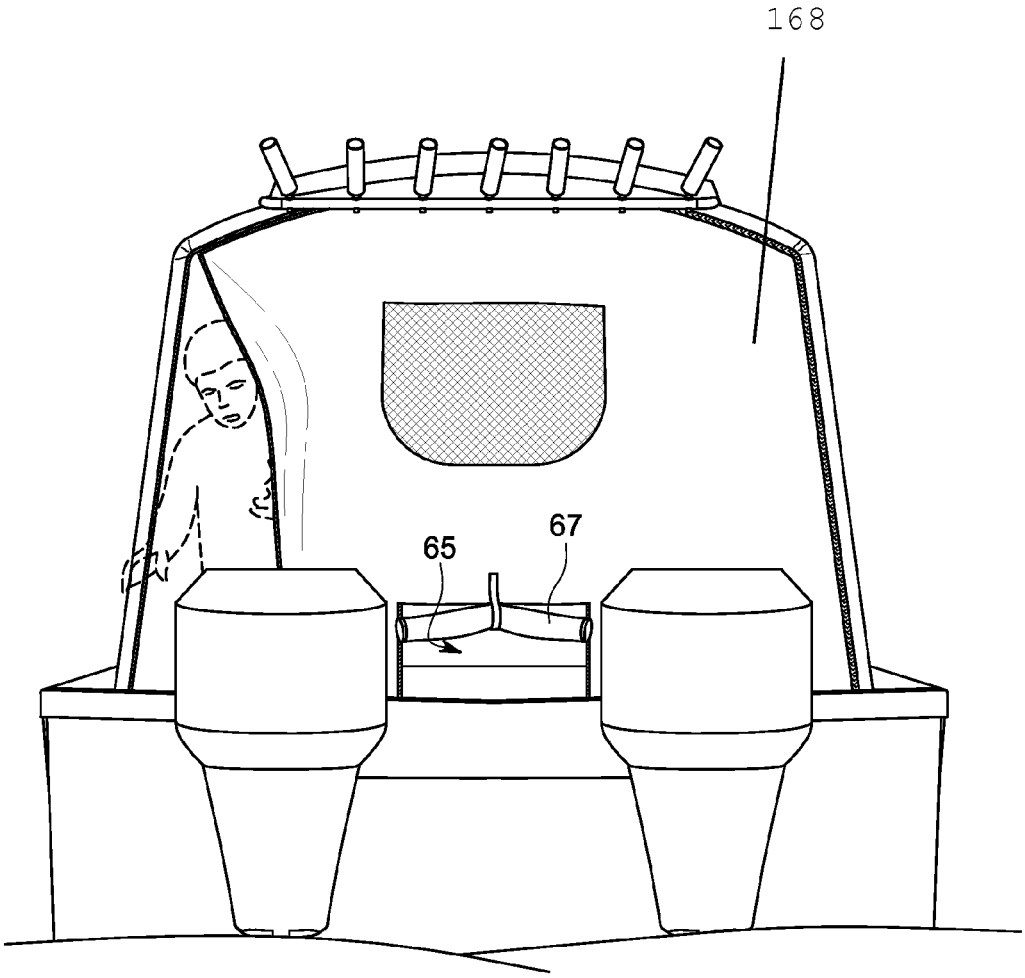
FIG. 2 illustrates a rear elevational view of the present invention with rear cover unit 168 partially open to permit a user to pass through. Bottom opening 65 is shown to allow for object to be passed through or accessed easily. Bottom opening cover 67 can be mounted to rear cover unit 168 and cooperates to selectively cover bottom opening 65.

Referring now to the drawings, where the present invention is generally referred to with numeral 10, it can be observed that it basically includes frame assembly 20, T-top mounting assembly 40, cover assembly 60, and anchoring assembly 80.

Figure 4:
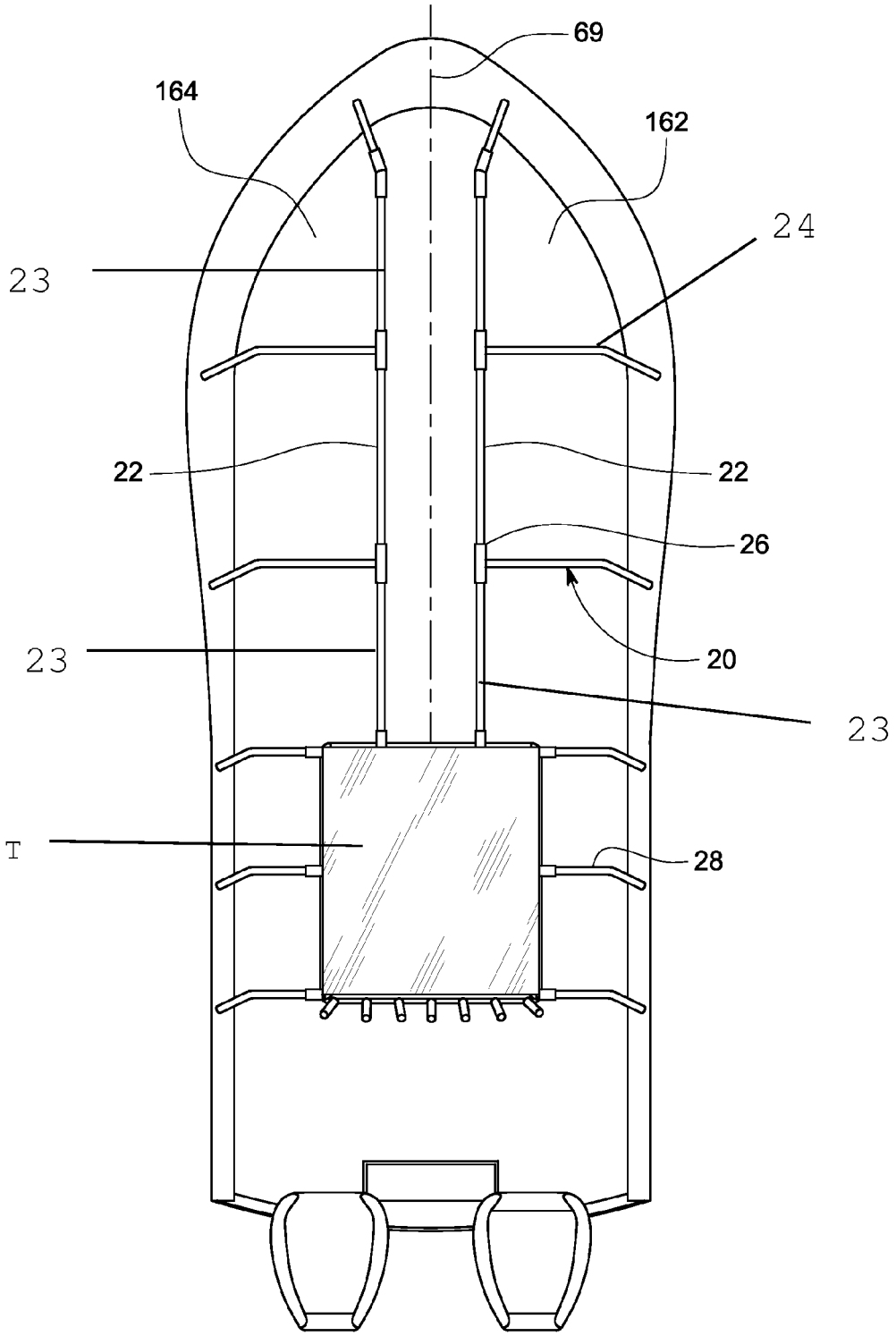
FIG. 4 is a top view of the present invention wherein frame assembly 20 is shown positioned to have cover assembly 60 mounted thereon.
Figure 5:
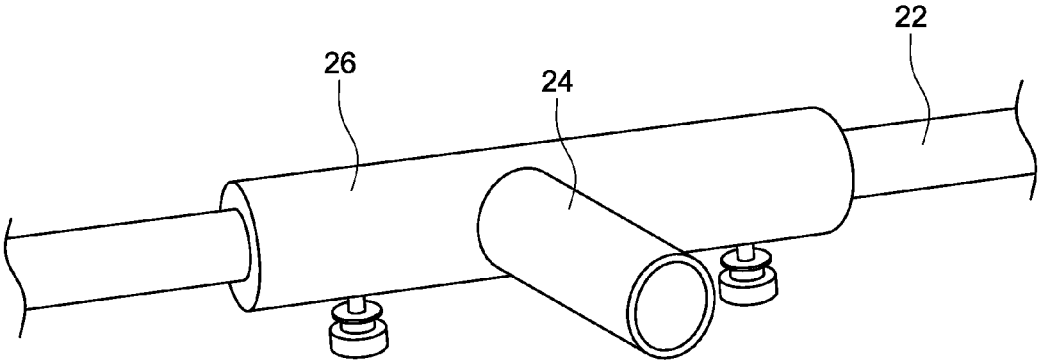
FIG. 5 is a partial view of longitudinal assemblies 22 mounted to each other using connector 26. Lateral rod member 24 is partially shown and mounted to connector 26.
Figure 5A:
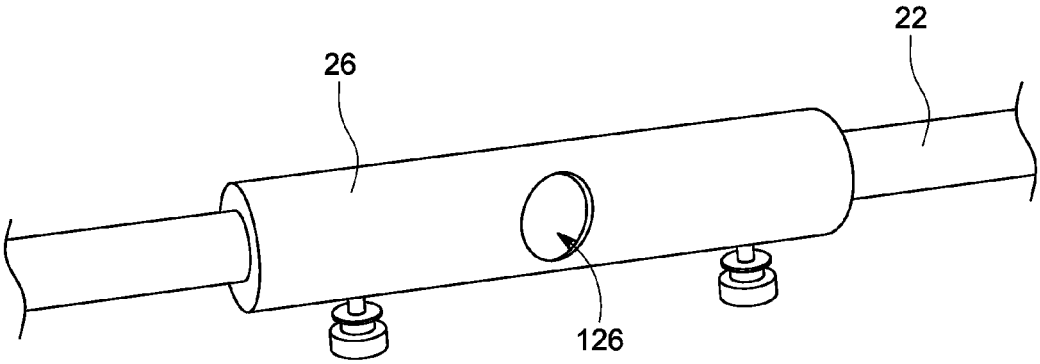
FIG. 5A is a partial view of longitudinal assemblies 22 mounted to each other using connector 26. Lateral rod member 24 has been removed to show cavity 126 used to receive and mount lateral rod member 24.
Figure 7:
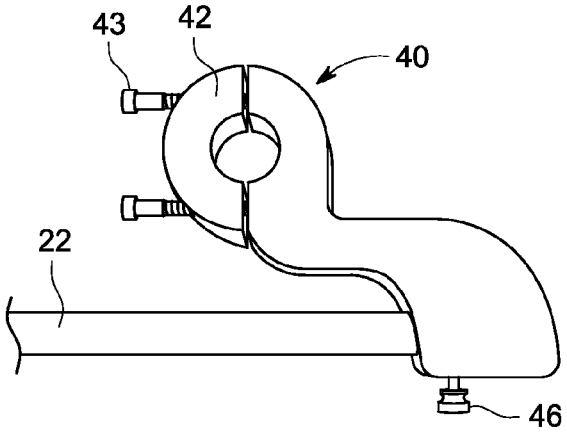
FIG. 7 is a side elevational view of T-Top mounting assembly 40 having clamp portion 42 and fastening members 43. Telescopic rod member fastening means 46 is shown at the bottom end of T-Top mounting assembly 40.
Figure 7A:
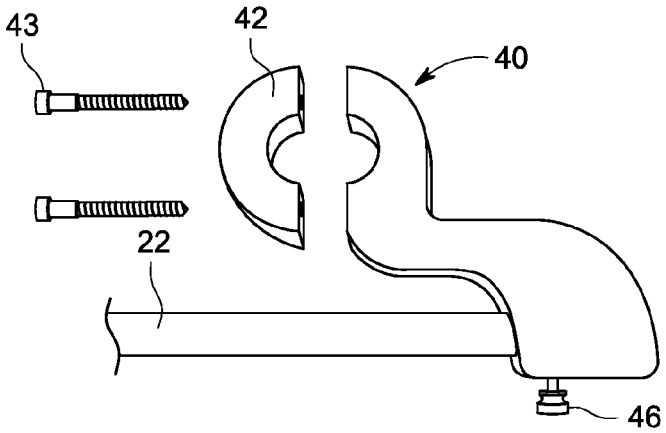
FIG. 7A shows an exploded view of T-Top mounted assembly 40 showing fastening members 43 in their entirety.
Figure 7B:
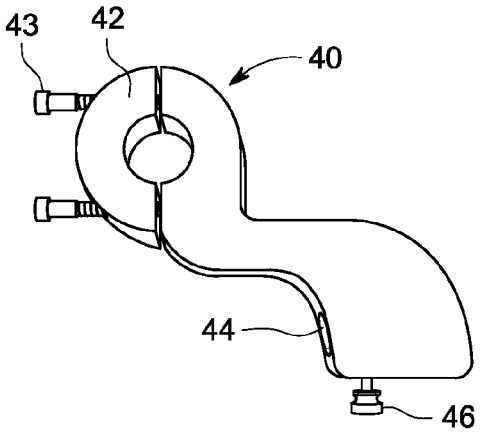
FIG. 7B is a side elevational view of T-Top mounting assembly 40 wherein longitudinal assemblies 22 has been removed to show cavity 44.
Figure 8:
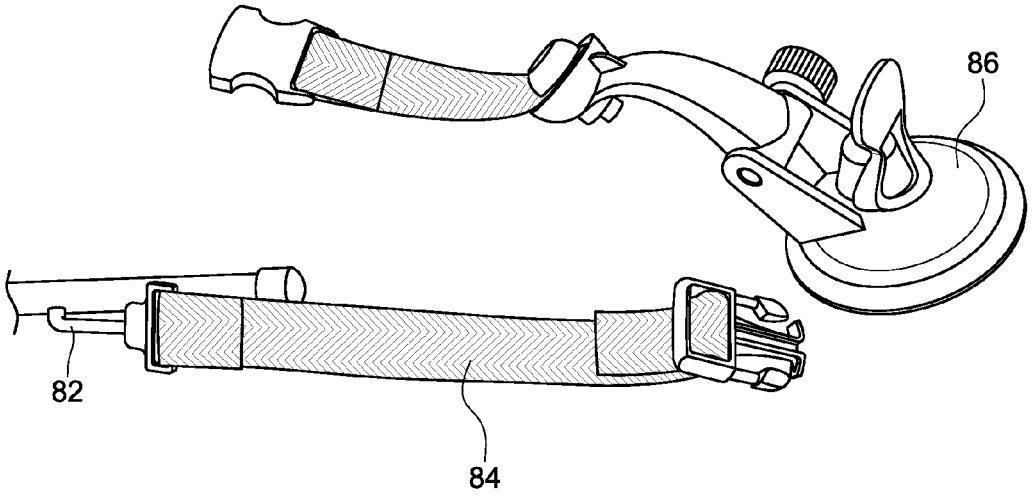
FIG. 8 is an isometric view of anchoring assembly 80 wherein suction anchoring member 86 is shown mounted to strap member 84 that is used to mount anchoring assembly to lateral telescopic members 24 using hook 82.
Figure 9:
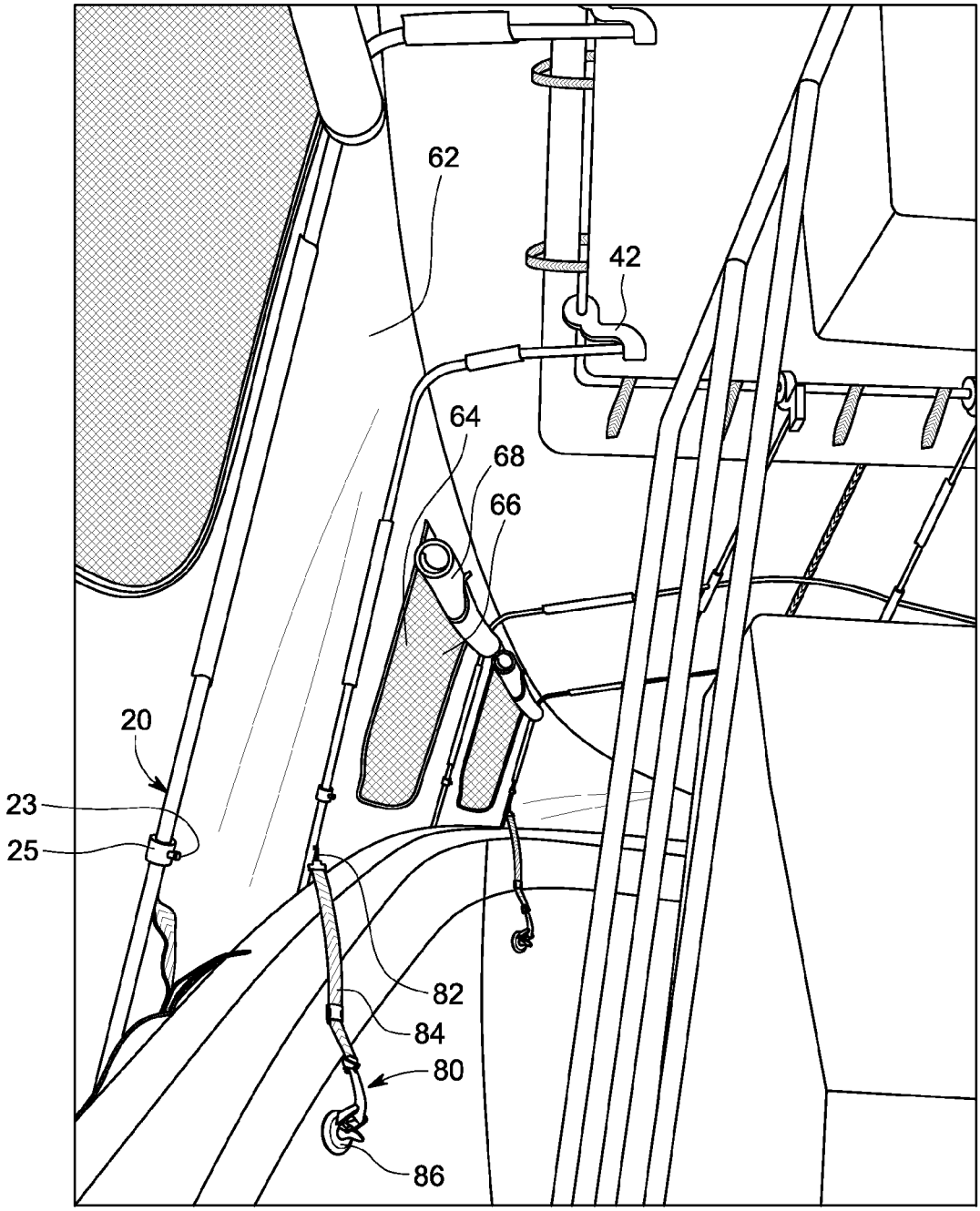
FIG. 9 is an isometric partial view of the inside of the boat having cover assembly 60 mounted thereon. T-Top mounting assembly 40 is seen mounted to the perimeter frame of T-Top T using clamp member 42. Anchoring assembly 80 is shown mounting lateral telescopic members 24 to the inner sides of the boat after having been passed through sleeves 61 of cover assembly 60.
Figure 9A:
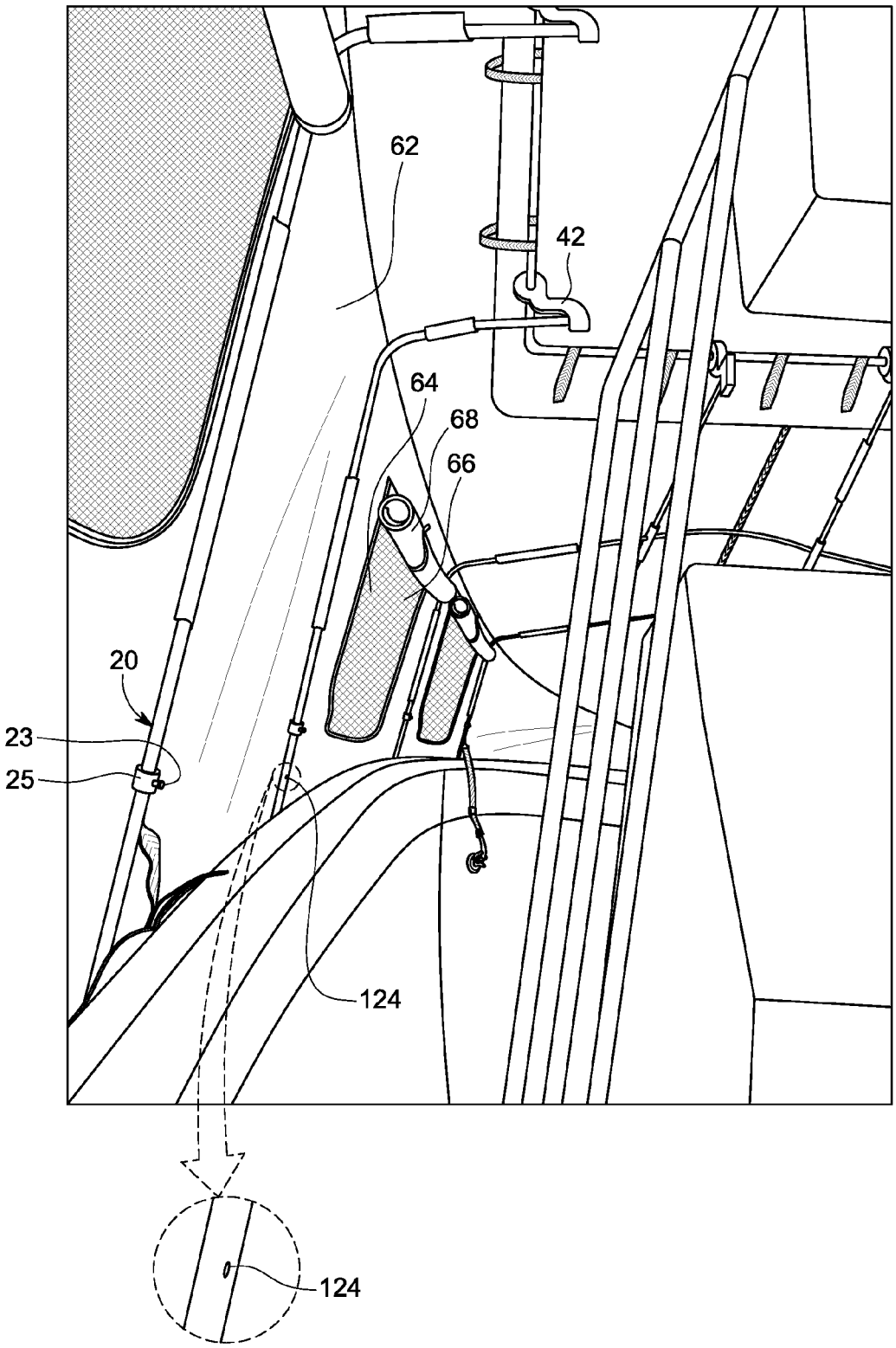
FIG. 9A shows an enlargement of lateral telescopic member 24 showing opening 124 used to receive hook 82 that is used to secure frame assembly 20 to anchoring assembly 80.
Figure 10:
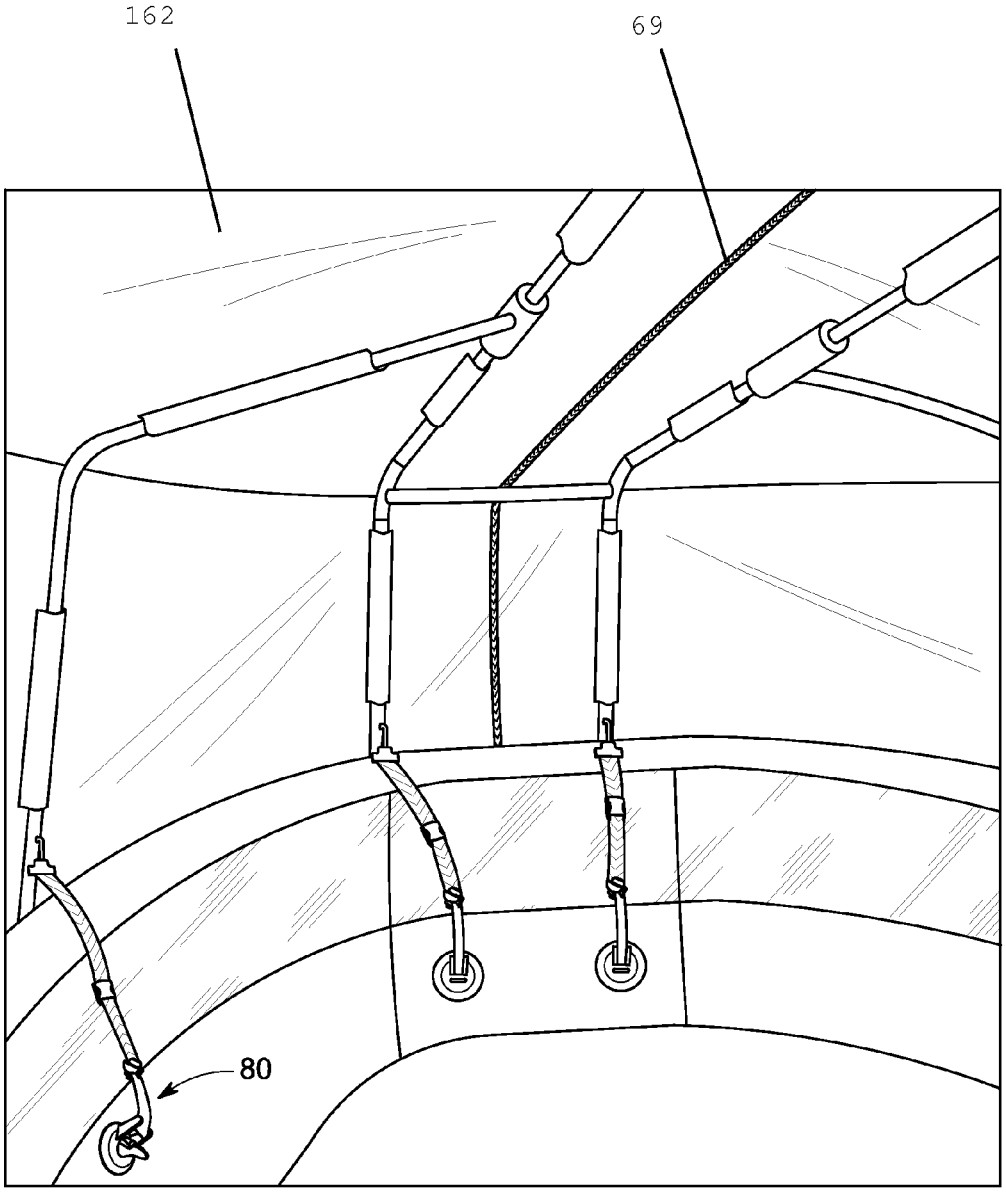
FIG. 10 is a partial view of the front of the boat having cover assembly 20 mounted thereon. Lateral telescopic members 24 can be seen mounted to telescopic rod members 22 using connector 26. Zipper 69 can be seen mounting both halves of cover unit 162 to each other.
Figure 11:
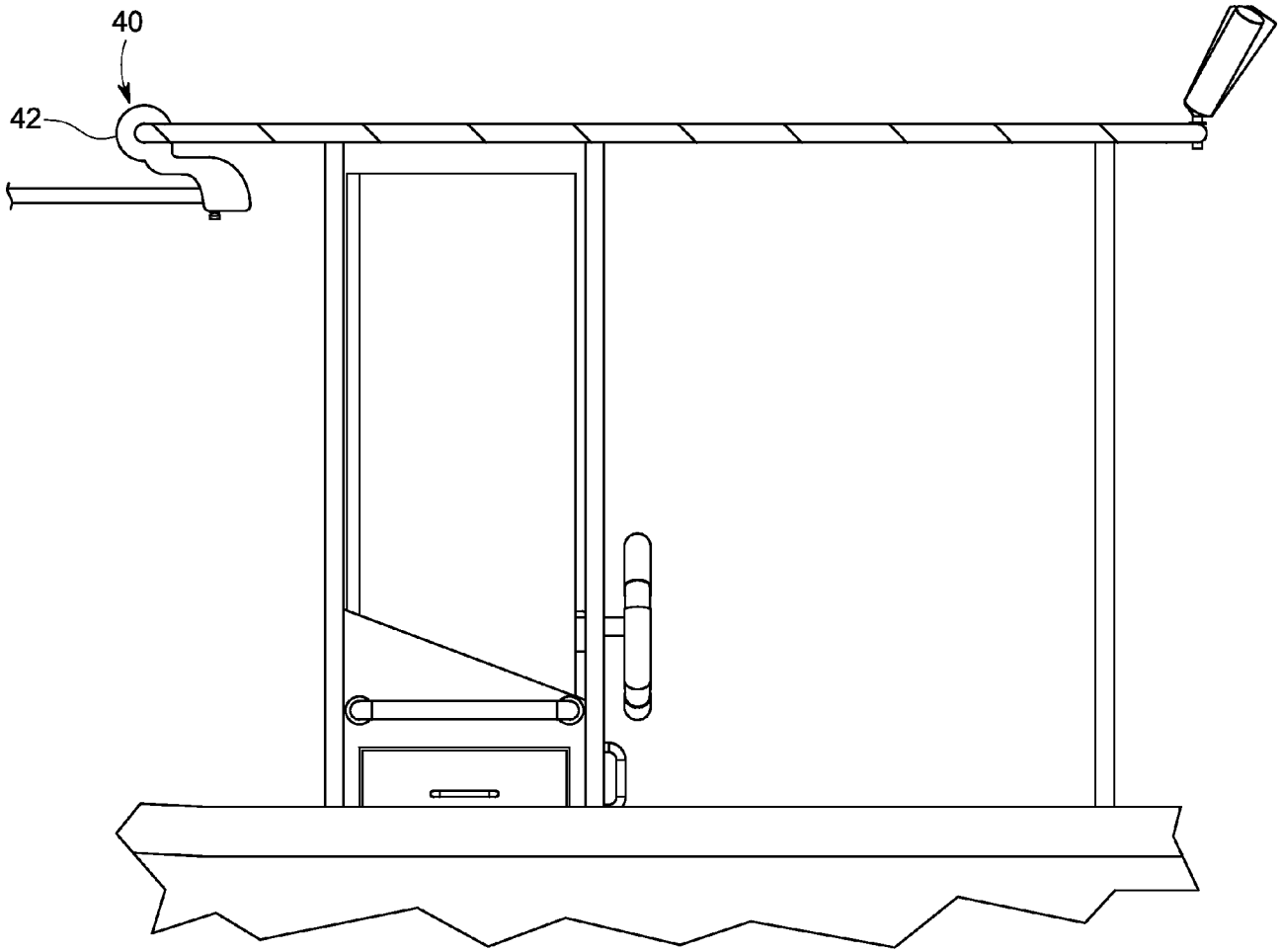
FIG. 11 is a side view of the boat wherein T-Top mounting assembly 40 can be seen in its operating environment and mounted to T-Top T using clamp member 42.
Figure 12:
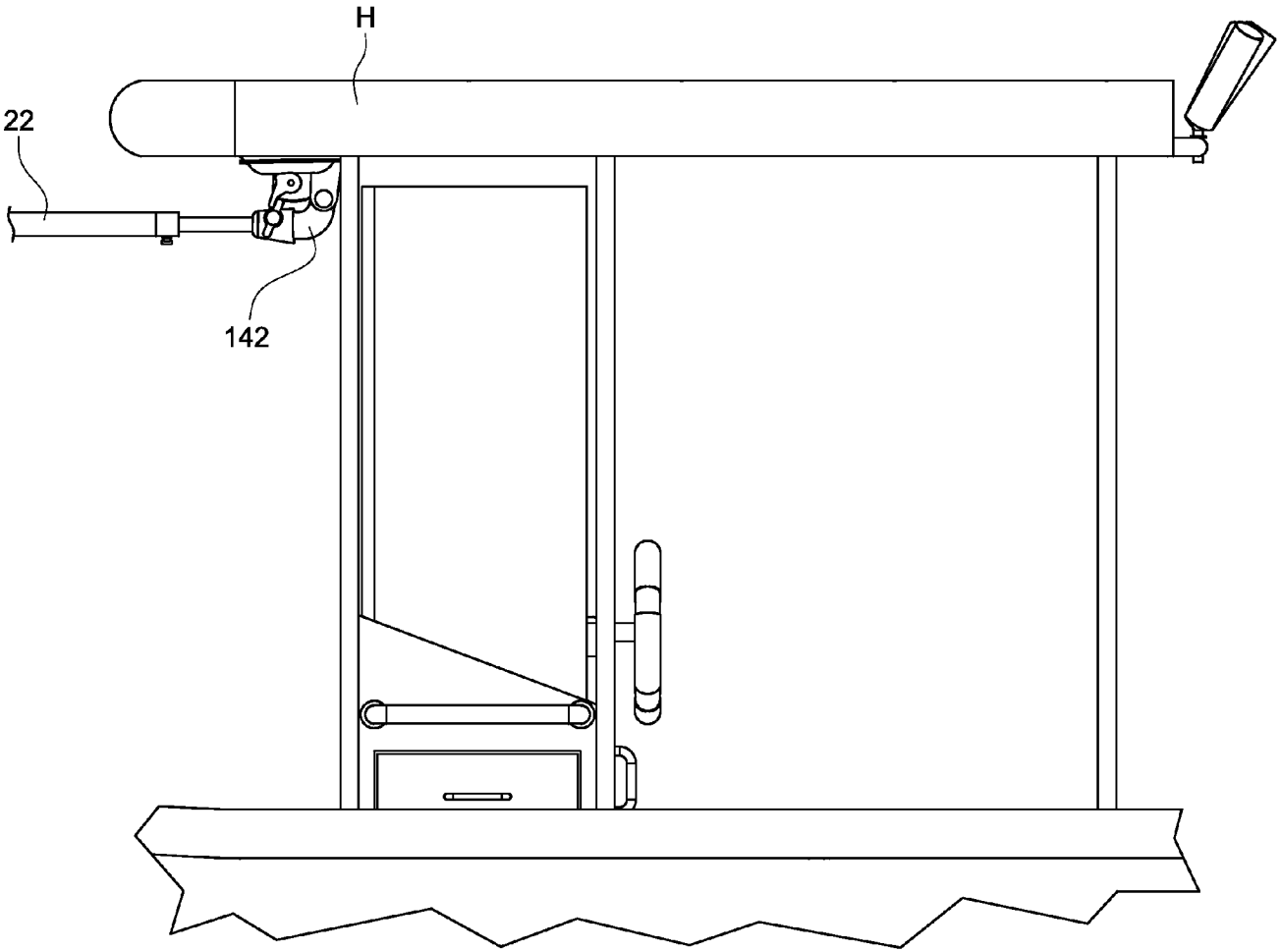
FIG. 12 is a side view of an alternate embodiment showing a boat having Hard Top H wherein Hard Top mounting assembly 40 can be seen in its operating environment and mounted to Hard Top H using suction mounting member 42.

As shown in FIG. 4, frame assembly 20 includes telescopic rod members 22 that are mounted to the T-Top of a boat using T-top mounting assembly 40. As seen in FIG. 9, T-Top mounting assembly 40 includes a plurality of clamp members 42 that mount onto the perimeter of a boat's T-Top T frame. Clamp members 42 include cavity 44 that receive telescopic rod members 22 as shown in FIG. 7B. Longitudinal assemblies 22 extend from the T-Top towards the distal ends of the boat (bow, stern, port, and starboard) as seen in FIG. 4. As also seen in FIG. 4, telescopic rod connectors 23 make up longitudinal assemblies 22 and are mounted to each other using connectors 26 at a predetermined location along their shaft. Connecters 26 include lateral cavity 126, shown in FIG. 5A, that receives lateral telescopic members 24. Lateral telescopic members 24 then extend towards the starboard or port of the boat as seen in FIG. 4.

Frame assembly 20 also includes T-Top lateral rod members 28 as shown in FIG. 4 that are mounted from the T-Top frame to the stern or port of the boat.

Figure 3:
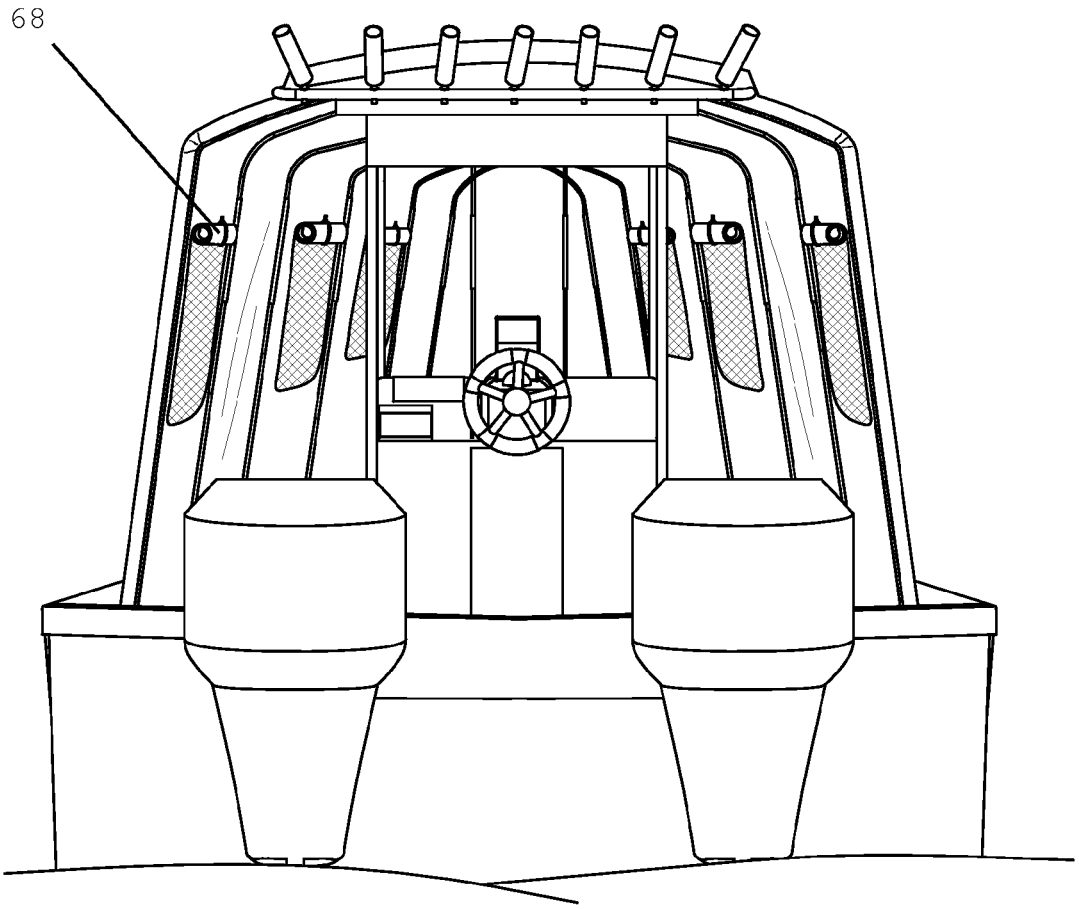
FIG. 3 is a representation of a rear elevational view of the present invention with rear cover unit 168 removed and window covers 68 can be seen rolled up inside of cover assembly 60.
Figure 3A:
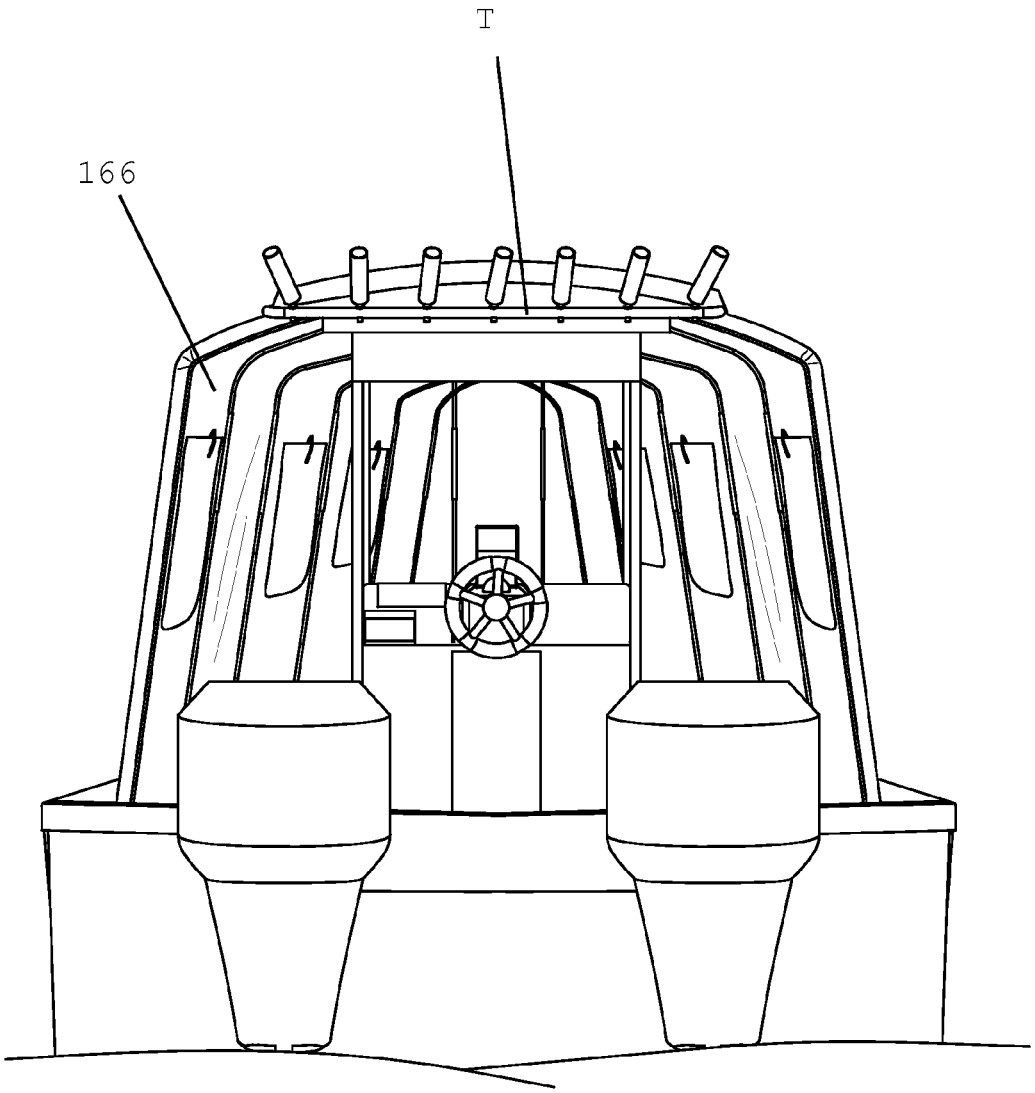
FIG. 3A illustrates a rear elevational view of the present invention wherein screen members 66 and window covers 68 have been removed.

Telescopic rod members 22 are inserted through sleeves 61 of cover assembly 60 thereby mounting cover 62 of cover assembly 60 to frame assembly 20. As seen in FIG. 3A, cover assembly 60 further includes window covers 68 that can be rolled up to allow light and wind to pass through or rolled down to prevent light and wind to pass through. Window covers 68 can be tightened sufficiently so as to substantially seal in the air conditioning used inside cover assembly 60. As shown in FIG. 1, cover assembly 60 comprises several cover units, namely, rear cover unit 168, side cover unit 166 and front cover unit 164.

At the distal ends of lateral telescopic members 24 there are openings 124 that are used to receive hook 82 of anchoring assembly 80. Hook 82 is connected to strap member 84 of suction anchoring member 86 which are then mounted to either the outer or inner perimeter of the boat.

Optionally, telescopic rod connectors 22 and lateral telescopic members 24 can be adjusted to provide greater tension to cover assembly 60. Cover assembly 60 includes window openings 64 that can be fitted with screen members 66.

Figure 6:
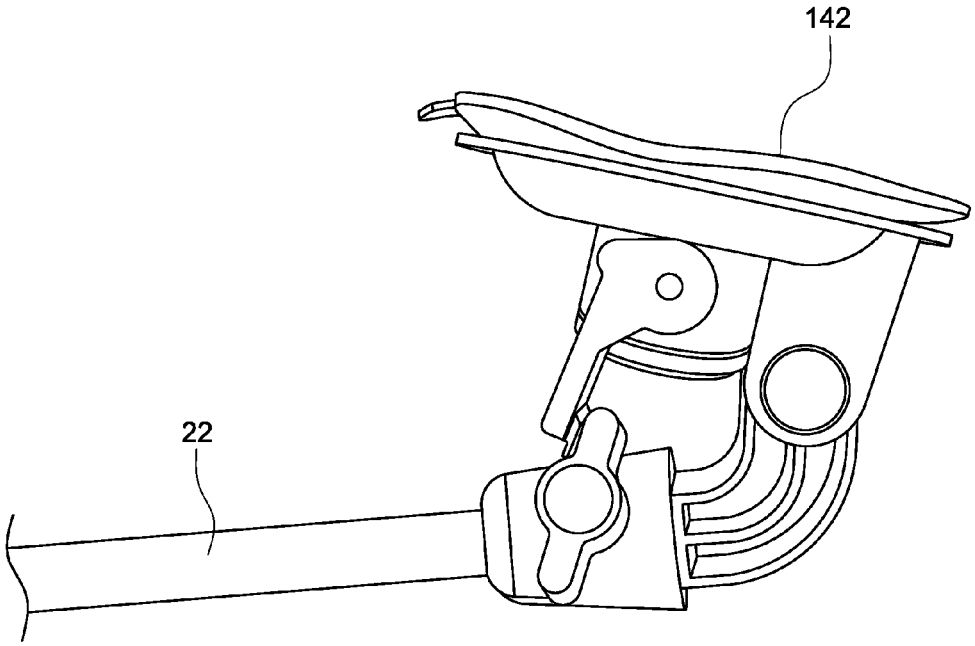
FIG. 6 shows a side view of an alternate embodiment using Hard Top mounting assembly 40 to be used on a boat having Hard Top H instead of T-Top T. Hard Top mounting assembly 40 is shown having suction cup member 142 at first distal end and second distal end is used to receive longitudinal assemblies 22.

In an alternate embodiment the present invention can be implemented into Hard Top style boats. In this embodiment T-Top assembly 40 uses suction members 142, shown in FIG. 6, to receive and mount telescopic rod members 22 to the Hard Top of the open fisherman style boat.

Cover units 164; 166; 168 can be preselectively mounted to frame assembly 20 depending on the user's desired usage. For instance, front cover unit 164 can be removed if a user desires to fish from the bow area of the boat. Side unit 166 can be removed and the other cover units left mounted if the user decides to fish from the port or starboard of the boat.

When storing and transporting frame assembly 20 can be disassembled and each rod member can be detached from connectors 26 to easily fit inside a case or bag. Similarly, mounting assembly 40, cover assembly 60, and anchoring assembly 80 can all be readily included in the case or bag.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A housing, comprising,

A) a frame assembly having at least two longitudinal assemblies at a spaced apart and parallel relationship with respect to each other, said longitudinal assemblies having a first end and a second end, said first end is mounted to a T-Top frame using a T-Top mounting assembly and second end mounted to an inner perimeter wall on the bow of a boat, said longitudinal assemblies each comprising a plurality of telescopic rod members connected to each other in sequence using connectors, said connectors having openings, said frame assembly includes lateral rod members that are inserted into said openings, said lateral rod members including a first lateral end and a second lateral end, said first lateral end is mounted to a predetermined inner portion of a side perimeter walls of said boat using an anchoring assembly, said second lateral end inserted into said openings of said connectors, said frame assembly also including T-Top lateral rod members having a first end and a second end, said first end is mounted to said T-Top frame using said T-Top mounting assembly and said second end is mounted to a predetermined inner portion of said side perimeter walls, said housing including a cover assembly having sleeves that is mounted to said frame assembly by passing said telescopic, T-Top lateral members, and lateral rod members through said sleeves.

2. The housing subject of claim 1 wherein said T-Top mounting assembly includes clamp members that are mounted at predetermined locations along the perimeter of said T-Top, said clamp members include an extension having an cavity wherein telescopic, T-Top lateral members, and lateral rod members are inserted and mounted to said clamp members.

3. The housing subject of claim 1 wherein said cover assembly includes a rear cover, side covers, and two front covers, said two front covers mounted to each other using a zipper.

4. The rear cover subject of claim 3 having a bottom opening and a bottom opening cover.

5. The cover assembly subject of claim 1 having window openings at preselected locations.

6. The cover assembly subject of claim 5 having a screen members covering each of said window openings.

7. The cover assembly subject of claim 5 having covers over each of said window coverings.

8. The housing subject of claim 1 wherein said anchoring assembly includes a suction member mounted to a perimeter wall of a boat, said suction member further includes a strap extending therefrom connected to a hook member, said hook member inserted into a cavity at a predetermined location on said lateral members and T-Top lateral rod members.

9. A housing, comprising, a frame assembly having longitudinal assemblies at a spaced apart and parallel relationship with respect to each other, mounted on first end to a Hard Top frame using a Hard Top mounting assembly and second end mounted to an inner perimeter wall on the bow of a boat, said longitudinal assemblies each being comprised of a plurality of telescopic rod members connected to each other in sequence using connectors, said connectors having openings, said frame assembly includes lateral rod members that are inserted into said openings on first end and second end mounted to a predetermined inner portion of side perimeter walls of said boat using an anchoring assembly, said frame assembly also including Hard Top lateral rod members mounted on first end to said Hard Top frame and mounted on second end to a predetermined inner portion of said side perimeter walls, said housing including a cover assembly having sleeves that it mounted to said frame assembly by passing said telescopic and lateral rod members through said sleeves.

10. The housing subject of claim 9 wherein said Hard Top mounting assembly includes suction members that are mounted at predetermined locations along the perimeter of said Hard Top, said suction members members include an extension having an cavity wherein telescopic, Hard Top lateral members, and lateral rod members are inserted and mounted to said clamp members.

11. The housing subject of claim 9 wherein said cover assembly includes a rear cover, side covers, and two front covers.

12. The rear cover subject of claim 11 having a bottom opening and a bottom opening cover.

13. The cover assembly subject of claim 9 having window openings at preselected locations.

14. The cover assembly subject of claim 13 having a screen members covering each of said window openings.

15. The cover assembly subject of claim 13 having covers over each of said window coverings.

16. The housing subject of claim 9 wherein said anchoring assembly includes a suction member mounted to a perimeter wall of a boat, said suction member further includes a strap extending therefrom connected to a hook member, said hook member inserted into a cavity at a predetermined location on said lateral members and Hard Top lateral rod members.

* * * * *